US009022515B2

(12) United States Patent
Ready et al.

(10) Patent No.: US 9,022,515 B2
(45) Date of Patent: May 5, 2015

(54) METHOD AND APPARATUS FOR MEASURING RESPONSE TO ACTUATION OF ELECTRO-MECHANICAL TRANSDUCER IN PRINT HEAD ASSEMBLY FOR INKJET PRINTING SYSTEM

(71) Applicant: Palo Alto Research Center Incorporated, Palo Alto, CA (US)

(72) Inventors: Steven E. Ready, Los Altos, CA (US); Christopher Paulson, Livermore, CA (US); Alan G. Bell, Los Altos, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 15 days.

(21) Appl. No.: 13/799,057

(22) Filed: Mar. 13, 2013

(65) Prior Publication Data

US 2014/0267488 A1 Sep. 18, 2014

(51) Int. Cl.

| | |
|---|---|
| ***B41J 29/393*** | (2006.01) |
| ***B41J 2/175*** | (2006.01) |
| ***B41J 2/045*** | (2006.01) |

(52) U.S. Cl.

CPC ..... *B41J 2/175* (2013.01); *B41J 2/0451* (2013.01); *B41J 2/04541* (2013.01); *B41J 2/04555* (2013.01); *B41J 2/04581* (2013.01)

(58) Field of Classification Search

CPC ..... B41J 2/0451

See application file for complete search history.

(56) References Cited

U.S. PATENT DOCUMENTS

| | | | | |
|---|---|---|---|---|
| 6,682,162 | B2 | 1/2004 | Simons et al. | |
| 6,910,751 | B2 | 6/2005 | Gröninger et al. | |
| 6,926,388 | B2 | 8/2005 | Gröninger et al. | |
| 7,357,474 | B2 | 4/2008 | Gröninger et al. | |
| 7,488,062 | B2 | 2/2009 | Boesten et al. | |
| 7,703,893 | B2 | 4/2010 | Gröninger et al. | |
| 7,866,781 | B2 | 1/2011 | Kim et al. | |
| 2002/0193068 | A1 * | 12/2002 | Sepehry-Fard | 455/3.02 |
| 2004/0159489 | A1 * | 8/2004 | Toda et al. | 180/446 |
| 2007/0279446 | A1 * | 12/2007 | Ishizaki | 347/19 |
| 2011/0193903 | A1 * | 8/2011 | Kim et al. | 347/10 |
| 2011/0285775 | A1 * | 11/2011 | Shinkawa | 347/14 |
| 2012/0206532 | A1 * | 8/2012 | Kim et al. | 347/19 |
| 2012/0262511 | A1 * | 10/2012 | Shinkawa et al. | 347/10 |

* cited by examiner

*Primary Examiner* — Shelby Fidler
(74) *Attorney, Agent, or Firm* — Fay Sharpe LLP

(57) ABSTRACT

A measurement device for measuring a response to actuation of an electro-mechanical transducer in a print head assembly for an inkjet printing system includes a sensing circuit and a measurement circuit. The sensing circuit provides a path to system ground for the transducer. The transducer is associated with an ink chamber in the print head assembly. The transducer is configured to transfer energy to contents of the chamber in response to an actuation of the transducer in conjunction with electronics controller and waveform amplifier modules of the printing system. The measurement circuit monitors a ground signal at a transducer-side of the sensing circuit and a reference signal at a system ground-side of the sensing circuit. The measurement circuit generates a difference signal indicative of a difference between the ground and reference signals. Various embodiments of methods for measuring the response and additional embodiments of devices are provided.

15 Claims, 8 Drawing Sheets

METHOD AND APPARATUS FOR MEASURING RESPONSE TO ACTUATION OF ELECTRO-MECHANICAL TRANSDUCER IN PRINT HEAD ASSEMBLY FOR INKJET PRINTING SYSTEM

BACKGROUND

The present exemplary embodiment relates generally to techniques for measuring a response to actuation of an electro-mechanical transducer in a print head assembly for an inkjet printing system. It finds particular application in methods and measurement devices for measuring the response of the transducer based on monitoring signals in the ground path of the transducer. However, it is to be appreciated that the exemplary embodiments described herein are also amenable to using recordings of the response signal in conjunction with subsequent operational or diagnostic testing of the transducer, print head assembly, or other components of the inkjet printing system.

Piezo element self-sensing is a method used in an inkjet printing system to gather information on the performance of ejectors in an inkjet print head. The technique involves recording drive/response signals from the actuation piezo elements in response to fluidic pressure waves immediately after the electrical signal that drives the piezo to eject a droplet. This technique was originally patented in the United States by Océ N. V. of The Netherlands (see, e.g., U.S. Pat. Nos. 6,682,162; 6,910,751; 6,926,388; 7,357,474; 7,488,062; and 7,703,893). The Océ patents describe the technique and various ways to either implement it or determine ejector characteristics. A similar technique was patented in the United States by Samsung (see, e.g., U.S. Pat. No. 7,866,781). The Samsung patent uses a differential configuration on the drive voltage coupled to a fixed capacitor that is matched to the capacitance of the piezo actuator.

INCORPORATION BY REFERENCE

The following documents are fully incorporated herein by reference: 1) U.S. Pat. No. 6,682,162 to Simmons et al.; 2) U.S. Pat. No. 6,910,751 to Groninger et al.; 3) U.S. Pat. No. 6,926,388 to Groninger et al.; 4) U.S. Pat. No. 7,357,474 to Groninger et al.; 5) U.S. Pat. No. 7,488,062 to Boesten et al.; 6) U.S. Pat. No. 7,703,893 to Groninger et al.; and 7) U.S. Pat. No. 7,866,781 to Kim et al.

BRIEF DESCRIPTION

In one aspect, a method for measuring a response to actuation of an electro-mechanical transducer in a print head assembly for an inkjet printing system is provided. In one embodiment, the method includes: providing at least a portion of a return path to system ground for an electro-mechanical transducer through a sensing circuit, wherein the electro-mechanical transducer is associated with an ink chamber in a print head assembly for an inkjet printing system, wherein the electro-mechanical transducer is configured to transfer energy to contents of the ink chamber in response to an actuation of the electro-mechanical transducer in conjunction with electronics controller and waveform amplifier modules of the inkjet printing system; monitoring a ground signal at an electro-mechanical transducer-side of the sensing circuit; monitoring a reference signal at a system ground-side of the sensing circuit; and generating a difference signal indicative of a difference between the ground and reference signals.

In another aspect, an apparatus for measuring a response to actuation of an electro-mechanical transducer in a print head assembly for an inkjet printing system is provided. In one embodiment, the apparatus includes a sensing circuit and a measurement circuit. The sensing circuit is configured to provide at least a portion of a return path to system ground for an electro-mechanical transducer. The electro-mechanical transducer is associated with an ink chamber in a print head assembly for an inkjet printing system. The electro-mechanical transducer is configured to transfer energy to contents of the ink chamber in response to an actuation of the electro-mechanical transducer in conjunction with electronics controller and waveform amplifier modules of the inkjet printing system. The measurement circuit is in operative communication with the sensing circuit and configured to monitor a ground signal at an electro-mechanical transducer-side of the sensing circuit and a reference signal at a system ground-side of the sensing circuit. The measurement circuit is also configured to generate a difference signal indicative of a difference between the ground and reference signals.

In yet another aspect, an apparatus for measuring a response to actuation of an electro-mechanical transducer in a print head assembly for an inkjet printing system is provided. In one embodiment, the apparatus includes a sensing circuit and an multi-stage amplifier circuit. The sensing circuit is configured to provide at least a portion of a return path to system ground for an electro-mechanical transducer. The electro-mechanical transducer is associated with an ink chamber in a print head assembly for an inkjet printing system. The electro-mechanical transducer is configured to transfer energy to contents of the ink chamber in response to an actuation of the electro-mechanical transducer in conjunction with electronics controller and waveform amplifier modules of the inkjet printing system. The multi-stage amplifier circuit is in operative communication with the sensing circuit and includes first, second, and third stage amplifier circuits. The first stage amplifier circuit is configured to monitor a ground signal at an electro-mechanical transducer-side of the sensing circuit and a reference signal at a system ground-side of the sensing circuit. The first stage amplifier circuit is also configured to generate a difference signal indicative of a difference between the ground and reference signals. The second and third stage amplifier circuits are in operative communication with the first stage amplifier circuit and configured to condition and amplify the difference signal to generate a response signal indicative of a response of the electro-mechanical transducer to fluidic pressure waves within the ink chamber after actuation of the electro-mechanical transducer.

DETAILED DESCRIPTION

This disclosure describes various embodiments of methods and measurement devices for measuring a response to actuation of an electro-mechanical transducer in a print head assembly for an inkjet printing system. The resulting response signal is based on the monitoring of signals in the return ground path for the transducer. The response signal is indicative of the response of the transducer to fluidic pressure waves within an ink chamber of the print head assembly after actuation of the transducer. A record of the response signal over a select time period can be used for subsequent operational or diagnostic testing of the transducer, print head assembly, or other components of the printing system.

The transducer, for example, may be a piezoelectric transducer which may also be referred to as a piezo actuator or piezo element. Piezo self-sensing, for example, can be used to gather information on the performance of ejectors in an inkjet print head. Signals are recorded from an actuation piezo element in response to fluidic pressure waves immediately after the electrical signal that drives the piezo to eject a droplet. The piezo electrical response is sensed by detecting a signal indicative of the ground return current for the piezo.

In one embodiment, an electronic circuit is used to detect the piezo ground return signal from one or more ejectors of an inkjet print head by monitoring the ground current between the print process control electronics/waveform amplifiers and the print head electronics. The return ground current is a shared connection to the piezo actuators. For example, a sensing resistor with less than one ohm resistance may be used in the ground current path to tap a voltage signal at a select portion of the ground return path. The voltage signal is fed into multiple gain stages with frequency filters and overvoltage protection diodes to limit overdriving the amplifiers. The diodes improve performance of the gain stage by preventing the corresponding amplifier from going into saturation.

Figure 1:
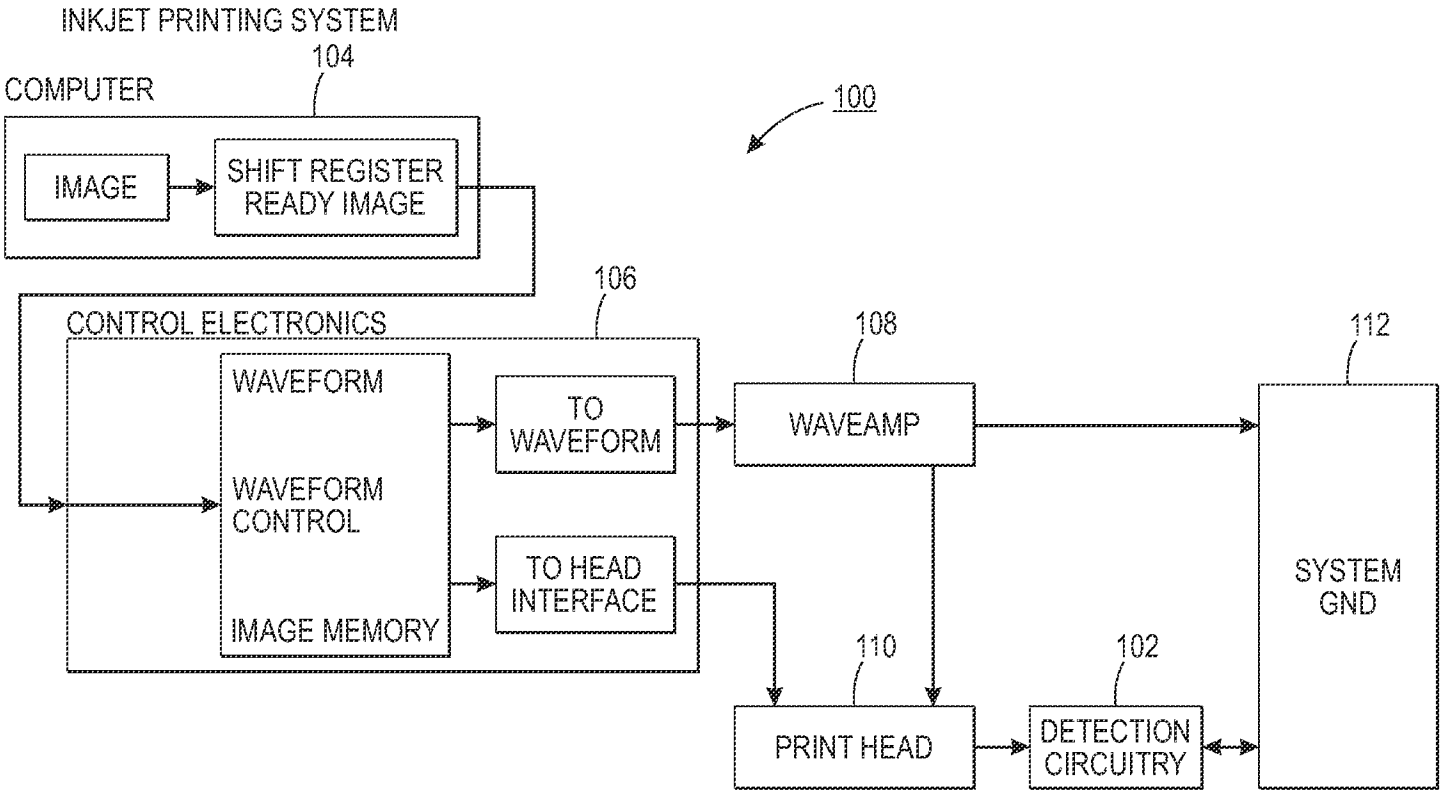
FIG. 1 is a block diagram of an exemplary embodiment of an inkjet printing system with an exemplary embodiment of a detection circuit for measuring a response to actuation of a piezoelectric transducer in a print head of the system.

With reference to FIG. 1, an exemplary embodiment of an inkjet printing system 100 includes an exemplary embodiment of a detection circuit 102 for measuring a response to actuation of a piezoelectric transducer in a print head of the system. The inkjet printing system 100 also includes a computer 104, a control electronics module 106, a waveform amplifier module 108, a print head assembly 110, and system ground 112. The computer 104 may include an image and a shift register ready image. In other embodiments, other suitable types of image source or input devices may be used instead of or along with the computer 104. For example, a scanner or a storage device may provide a source image to the control electronics 106. The control electronics 106 includes an image memory, a waveform control, a waveform, and interfaces to the waveform amplifier 108 and the print head assembly 110. The detection circuitry 102 monitors a ground signal from a piezoelectric transducer within the print head assembly 110 via a sensing circuit. The detection circuitry 102 also monitors a reference signal between the sensing circuit and system ground 112. The detection circuitry 102 measures the response to actuation of the piezoelectric transducer by determining a difference between the monitored signals. The detection circuitry 102 may also condition and amplify the difference signal to provide a suitable response signal for use in operational or diagnostic testing of the piezoelectric transducer, print head assembly 110, or other components of the inkjet printing system 100.

Figure 2:
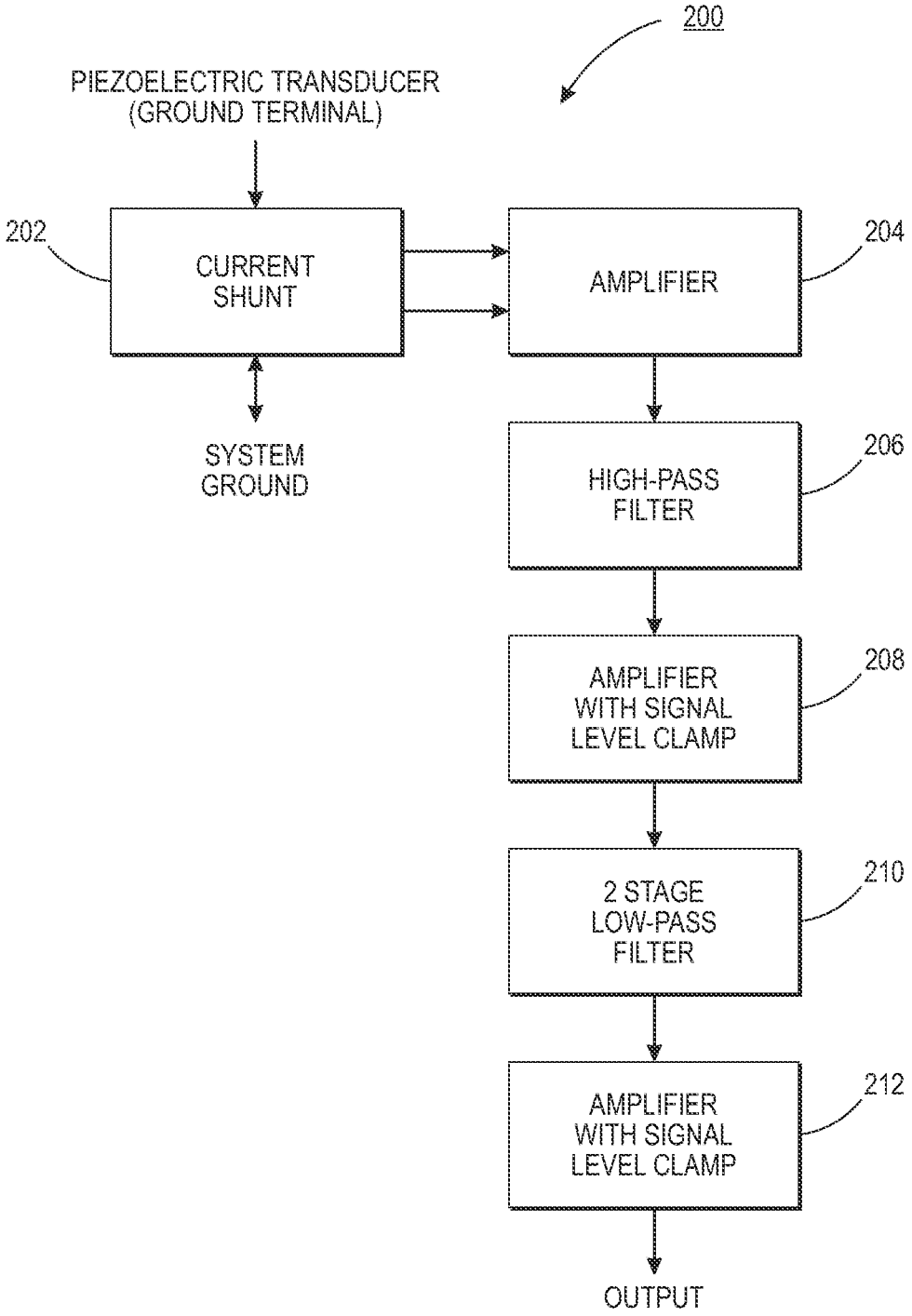
FIG. 2 is a block diagram of an exemplary embodiment of a detection circuit for measuring a response to actuation of a piezoelectric transducer in a print head assembly for an inkjet printing system.

With reference to FIG. 2, an exemplary embodiment of a detection circuit 200 for measuring a response to actuation of a piezoelectric transducer in a print head assembly for an inkjet printing system includes a current shunt 202, an first amplifier 204, a high-pass filter 206, a second amplifier 208, a low-pass filter 210, and a third amplifier 210. The current shunt 202 is configured to provide a return ground path for a piezoelectric transducer in a print head assembly for an inkjet printing system. The return ground path is provided by connecting the current shunt 202 between a ground-side of the piezoelectric transducer and system ground. The detection circuit 200 monitors a ground signal from the piezoelectric transducer via the current shunt 202. The detection circuit 200 also monitors a reference signal between the current shunt 202 and system ground. The first amplifier 204 measures the response to actuation of the piezoelectric transducer by determining a difference between the monitored signals. The high-pass and low-pass filters 206, 210 condition the measured signal. The second and third amplifiers 208, 212 amplify the measured, conditioned signal to provide a suitable response signal for use in operational or diagnostic testing of the piezoelectric transducer, print head assembly, or other components of the inkjet printing system. The second and third amplifiers 208, 212 may each include signal level clamps to limit overdriving the corresponding amplifiers. The low-pass filter 210 may include two stages.

Figure 3:
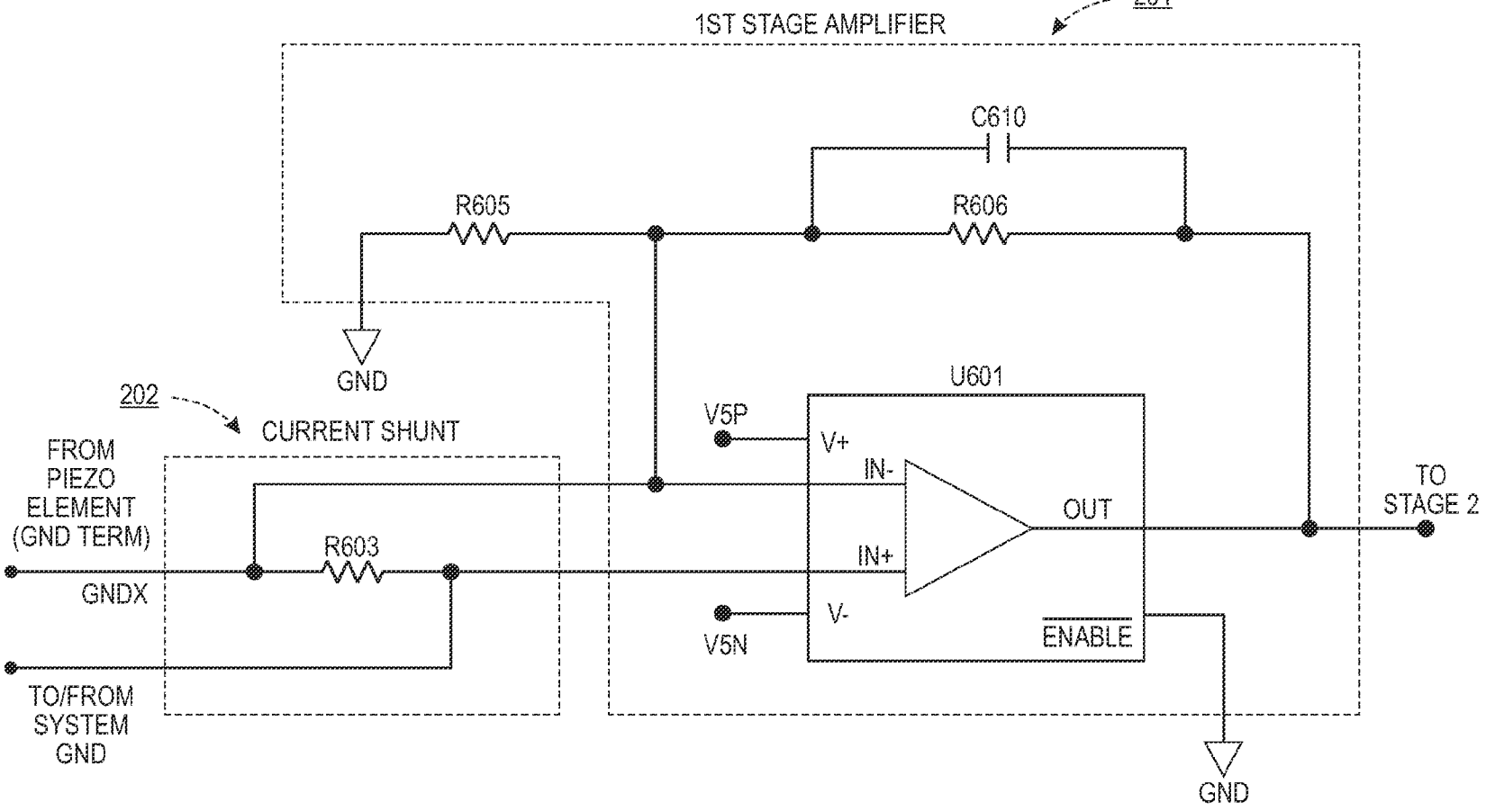
FIG. 3 is a circuit diagram of a first portion of an exemplary embodiment of a detection circuit for measuring a response to actuation of a piezoelectric transducer in a print head assembly for an inkjet printing system.

With reference to FIG. 3, a first portion of the detection circuit 200 of FIG. 2 in shown with exemplary circuits for the current shunt 202 and first amplifier 204. The exemplary circuit for the current shunt 202 includes resistor R603. The exemplary circuit for the first amplifier 204 includes operational amplifier U601, resistors 605 and 606, and capacitor C610.

Figure 4:
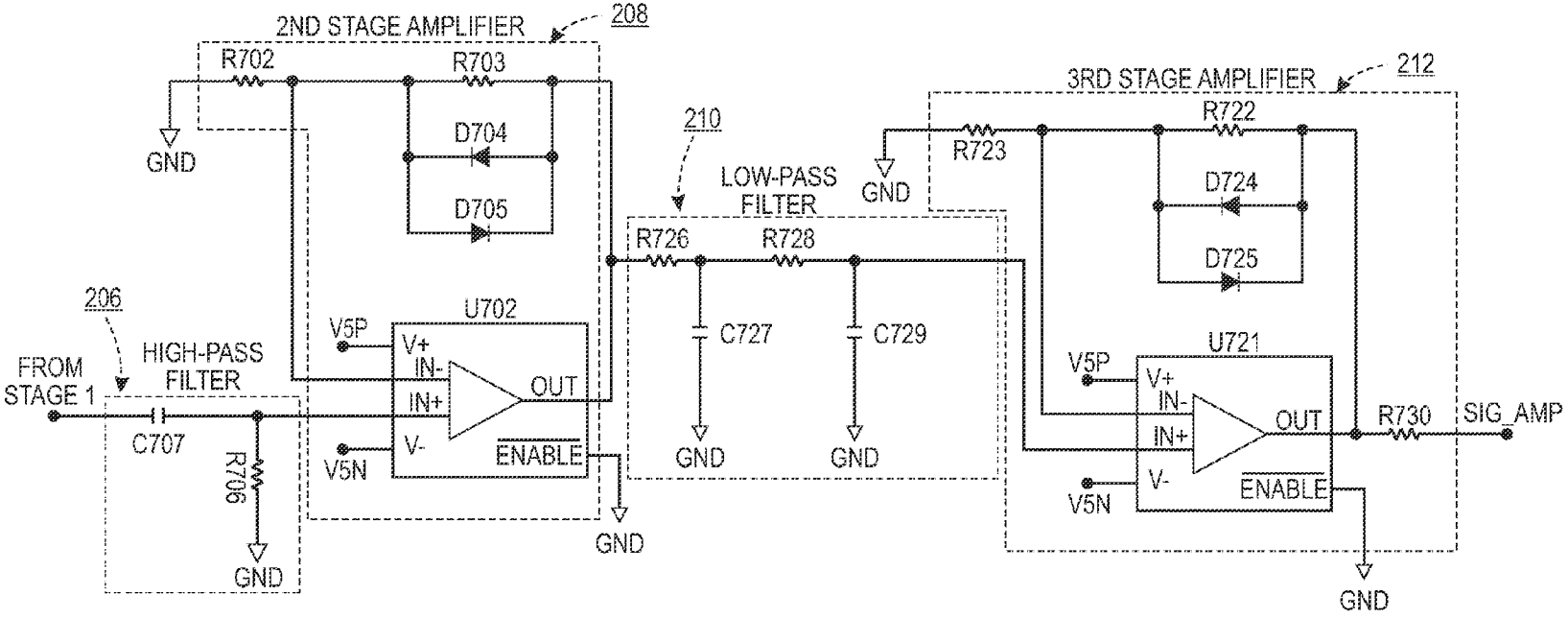
FIG. 4 is a circuit diagram of a second portion of the exemplary embodiment of the detection circuit for which the first portion is depicted in FIG. 3.

With reference to FIG. 4, a second portion of the detection circuit 200 of FIG. 2 is shown with exemplary circuits for the high-pass filter 206, second amplifier 208, low-pass filter 210, and third amplifier 212. The exemplary circuit for the high-pass filter 206 includes resistor R706 and capacitor C707. The exemplary circuit for the second amplifier 208 includes operational amplifier U702, resistors R702 and R703, and diodes D704 and D705. The exemplary circuit for the low-pass filter 210 includes resistors R726 and R728 and capacitors C727 and C729. The exemplary circuit for the third amplifier 212 includes operational amplifier U721, resistors R722, R723, and R730, and diodes D724 and D725.

Figure 5:
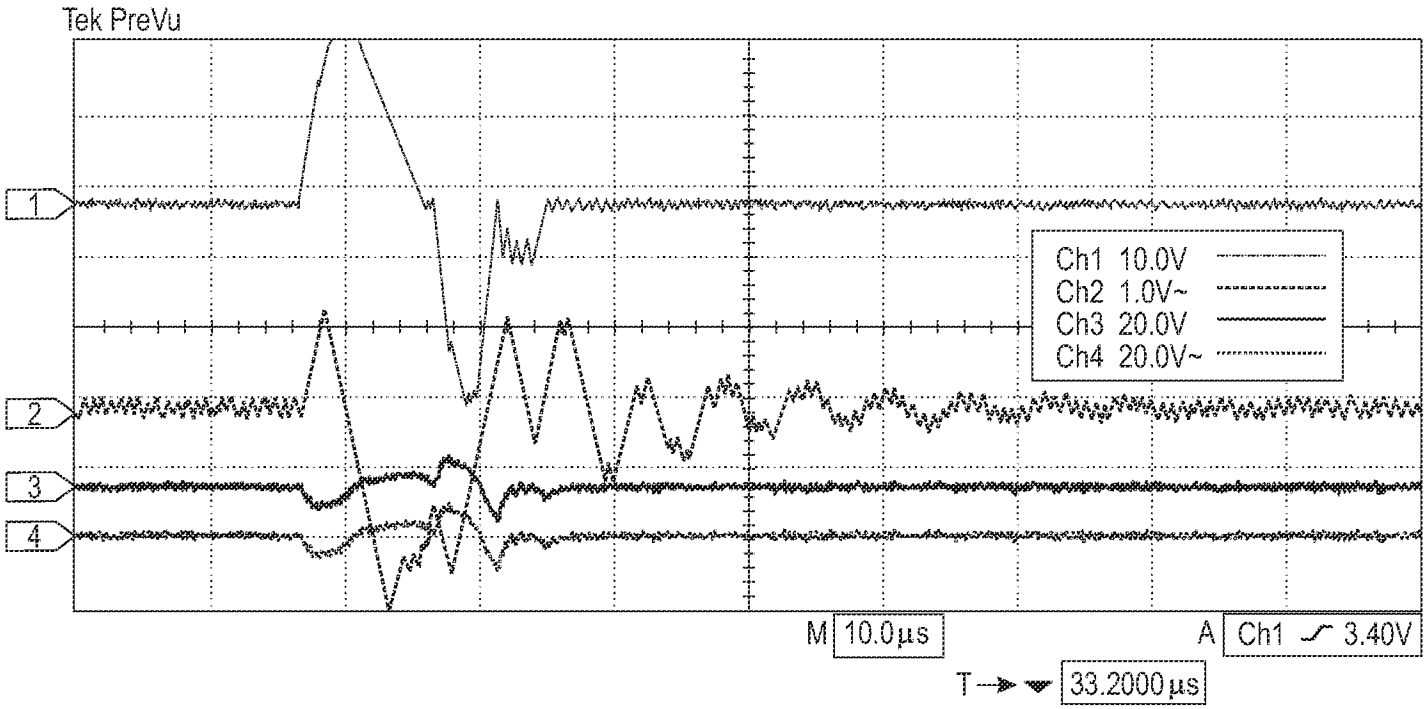
FIG. 5 is an exemplary display from a test equipment device set up to monitor an actuation signal associated with a piezoelectric transducer, ground and reference signals associated with the piezoelectric transducer and inputs to the detection circuit, and a response signal output of the detection circuit.
Figure 7:
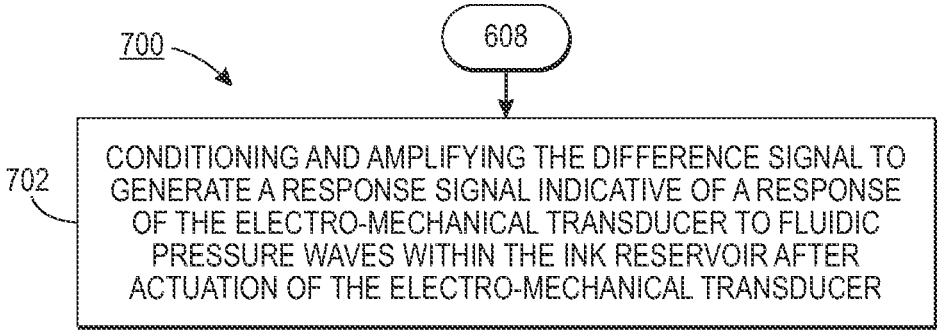
FIG. 7, in combination with FIG. 6, is a flowchart of another exemplary embodiment of a process for measuring a response to actuation of an electro-mechanical transducer in a print head assembly for an inkjet printing system.
Figure 8:
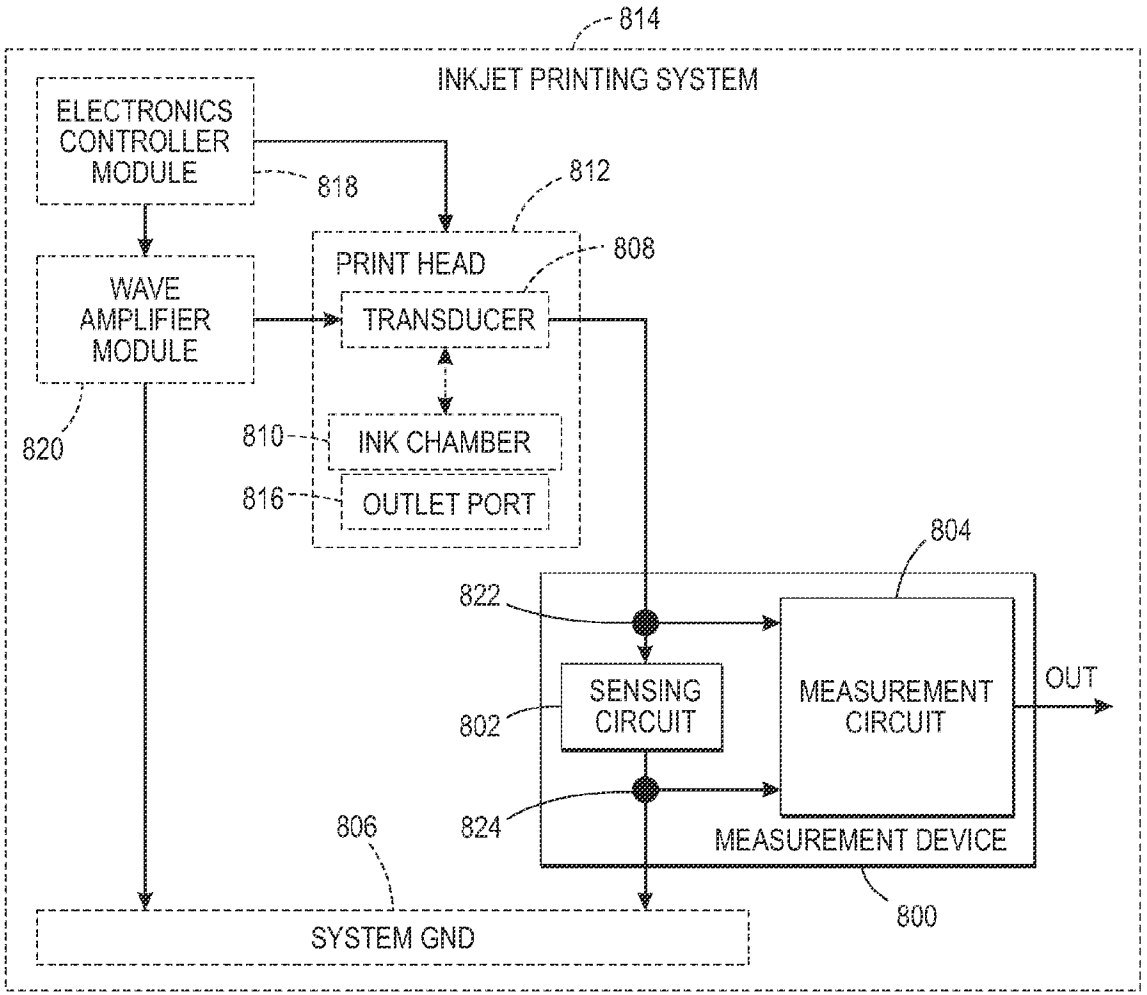
FIG. 8 is a block diagram of an exemplary embodiment of a measurement device for measuring a response to actuation of an electro-mechanical transducer in a print head assembly for an inkjet printing system.

With reference to FIG. 5, an exemplary display from a test equipment device shows four waveforms from certain points in an inkjet printing system such as the systems depicted in FIGS. 1, 7, and 8. The test equipment device is set up to monitor an actuation signal associated with an electro-mechanical transducer, ground and reference signals associated with the transducer that are inputs to a measurement device, and a response signal output from the measurement device. Waveform 1 shows the actuation signal supplied to the transducer from a waveform amplifier module. Waveform 3 shows the ground signal at the transducer-side of the sensing circuit. Waveform 4 shows the reference signal at the system ground-side of the sensing circuit. Waveform 2 shows the response signal at the output of the measurement circuit. Waveform 2 depicts a damped resonance signal from the return ground path for the transducer in conjunction with actuation for ejection of an ink droplet from a chamber of the print head assembly for the inkjet printing system.

Figure 6:
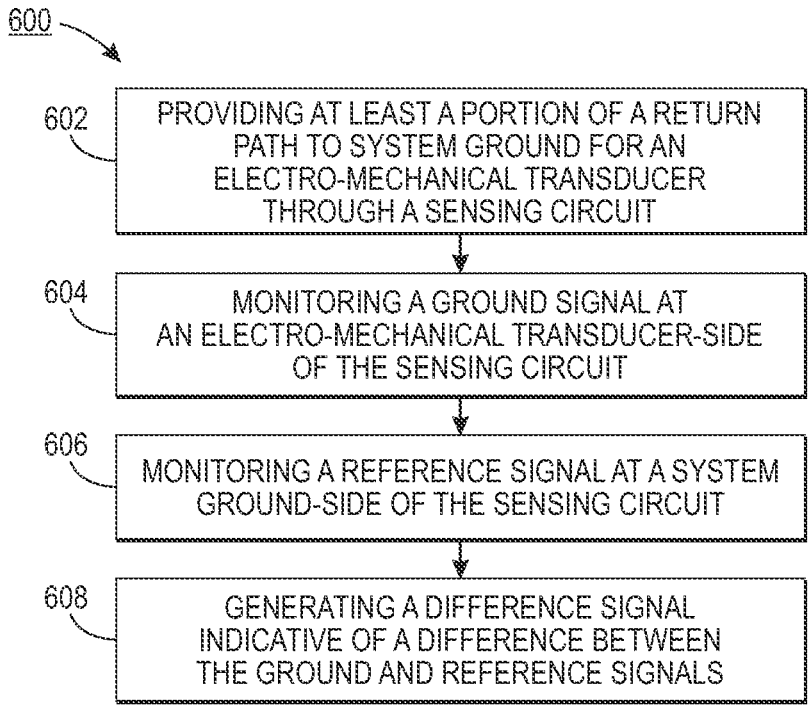
FIG. 6 is a flowchart of an exemplary embodiment of a process for measuring a response to actuation of an electro-mechanical transducer in a print head assembly for an inkjet printing system.

With reference to FIG. 6, an exemplary embodiment of a process 600 for measuring a response to actuation of an electro-mechanical transducer in a print head assembly for an inkjet printing system begins at 602 where at least a portion of a return path to system ground for an electro-mechanical transducer is provided through a sensing circuit. The electro-mechanical transducer is associated with an ink chamber in a print head assembly for an inkjet printing system. The electro-mechanical transducer is configured to transfer energy to contents of the ink chamber in response to an actuation of the electro-mechanical transducer in conjunction with electronics controller and waveform amplifier modules of the inkjet printing system. The drive signal for actuation of the electro-mechanical transducer may be for ejection of ink through an outlet port of the ink chamber. Alternatively, the drive signal may a sub-ejection signal for other purposes, such as for warming the ink. Next, a ground signal at an electro-mechanical transducer-side of the sensing circuit is monitored (604). At 606, a reference signal at a system ground-side of the sensing circuit is monitored. Next, a difference signal indicative of a difference between the ground and reference signals is generated (608).

In another embodiment of the process 600, the electro-mechanical transducer includes a piezoelectric transducer, any suitable transducer, or any suitable actuator/sensor component in any suitable combination. In yet another embodiment of the process 600, the sensing circuit includes a current shunt device. In still another embodiment of the process 600, the sensing circuit includes a sensing resistor. In still yet another embodiment of the process 600, the difference signal is generated by at least one of a differential amplifier circuit, an operational amplifier circuit, an multi-stage amplifier circuit, or any suitable amplifier circuit in any suitable combination.

With reference to FIGS. 6 and 7, another exemplary embodiment of a process 700 for measuring a response to actuation of an electro-mechanical transducer in a print head assembly for an inkjet printing system includes the process 600 of FIG. 6. From 608, the process 700 continues to 702 where the difference signal is conditioned and amplified to generate a response signal indicative of a response of the electro-mechanical transducer to fluidic pressure waves within the ink chamber after actuation of the electro-mechanical transducer.

In another embodiment of the process 700, the conditioning includes at least one of high-pass filtering, band-pass filtering, low-pass filtering, or any suitable form of signal conditioning in any suitable combination. For example, high-pass and low-pass filtering can be arranged to produce band-pass filtering. In yet another embodiment of the process 700, the response signal is generated using at least one of a differential amplifier circuit, an operational amplifier circuit, an multi-stage amplifier circuit, or any suitable amplifier circuit in any suitable combination.

In still another embodiment of the process 700, the response signal is generated using an multi-stage amplifier circuit in which a first amplifier stage is used to generate the difference signal and second and third amplifier stages are used to generate the response signal. In this embodiment, the first amplifier stage may include an instrumentation amplifier. In a further embodiment, the second and third amplifier stages include overvoltage protection diodes to limit overdriving the corresponding amplifier stage. In this embodiment, the diodes improve performance of the amplifier stages by preventing the corresponding amplifier from going into saturation. In another further embodiment, the conditioning includes using a high-pass filter between the first and second amplifier stages and using a low-pass filter between the second and third amplifier stages. In an even further embodiment, the low-pass filter includes a two-stage low-pass filter.

In still yet another embodiment, the process 700 also includes recording the response signal over a select time period for subsequent testing of at least one of the print head assembly or inkjet printing system. In another embodiment, the process 700 also includes at least temporarily storing a recording of the response signal over a select time period in a storage device for the subsequent testing of at least one of the print head assembly or inkjet printing system.

With reference to FIG. 8, a measurement device 800 for measuring a response to actuation of an electro-mechanical transducer in a print head assembly for an inkjet printing system includes a sensing circuit 802 and a measurement circuit 804. The sensing circuit 802 is configured to provide at least a portion of a return path to system ground 806 for an electro-mechanical transducer 808. The electro-mechanical transducer 808 is associated with an ink chamber 810 in a print head assembly 812 for an inkjet printing system 814. The electro-mechanical transducer 808 is configured to transfer energy to contents of the ink chamber 810 in response to an actuation of the electro-mechanical transducer 808 in conjunction with electronics controller and waveform amplifier modules 818, 820 of the inkjet printing system 814. The drive signal for actuation of the electro-mechanical transducer 808 may be for ejection of ink through an outlet port 816 of the ink chamber 810. Alternatively, the drive signal may a sub-ejection signal for other purposes, such as for warming the ink. The measurement circuit 804 is in operative communication with the sensing circuit 802 and configured to monitor a ground signal at an electro-mechanical transducer-side 822 of the sensing circuit and a reference signal at a system ground-side 824 of the sensing circuit 802. The measurement circuit 804 is also configured to generate a difference signal indicative of a difference between the ground and reference signals.

In another embodiment, the electro-mechanical transducer 808 includes a piezoelectric transducer. In yet another embodiment of the measurement circuit 800, the sensing circuit 802 includes a current shunt device. In still another embodiment of the measurement circuit 800, the sensing circuit 802 includes a sensing resistor. In still yet another embodiment, the measurement circuit 800 is configured to use at least one of a differential amplifier circuit, an operational amplifier circuit, an multi-stage amplifier circuit, or any suitable amplifier circuit in any suitable combination in conjunction with generating the difference signal.

In another embodiment, the measurement circuit 800 is also configured to condition and amplify the difference signal to generate a response signal indicative of a response of the electro-mechanical transducer 808 to fluidic pressure waves within the ink chamber 810 after actuation of the electro-mechanical transducer 808. In a further embodiment, the measurement circuit 800 is configured to use at least one of high-pass filtering, band-pass filtering, low-pass filtering, or any suitable form of signal conditioning in any suitable combination in conjunction with the conditioning. For example, high-pass and low-pass filtering can be arranged to produce band-pass filtering. In another further embodiment, the measurement circuit 800 is configured to use at least one of a differential amplifier circuit, an operational amplifier circuit, an multi-stage amplifier circuit, or any suitable amplifier circuit in any suitable combination in conjunction with generating the response signal.

In yet another further embodiment, the measurement circuit 800 includes an multi-stage amplifier circuit with first, second, and third amplifier stages. In this embodiment, the first amplifier stage is configured to generate the difference signal and the second and third amplifier stages are configured to generate the response signal. In the embodiment being described, the first amplifier stage may include an instrumentation amplifier. In an even further embodiment, the second and third amplifier stages each includes overvoltage protection diodes configured to limit overdriving the corresponding amplifier stage. In this embodiment, the diodes improve performance of the amplifier stages by preventing the corresponding amplifier from going into saturation. In another even further embodiment, the multi-stage amplifier circuit also includes a high-pass filter between the first and second amplifier stages in conjunction with conditioning the difference signal. In this embodiment, the multi-stage amplifier circuit also includes a low-pass filter between the second and third amplifier stages in conjunction with conditioning an intermediate signal associated with the response signal. In an even yet further embodiment, the low-pass filter includes a two-stage low-pass filter.

In still another further embodiment, the measurement circuit 800 is also configured to facilitate recording of the response signal over a select time period for subsequent testing of at least one of the print head assembly 812, inkjet printing system 814, or any combination of components of the inkjet printing system 814. In still yet another further embodiment, the measurement device 800 also includes a storage device in operative communication with the measurement circuit and configured to at least temporarily store a recording of the response signal over a select time period for subsequent testing of at least one of the print head assembly 812, inkjet printing system 814, or any combination of components of the inkjet printing system 814.

In other embodiments, the storage device may be an integral component of the measurement circuit 800, print head assembly 812, electronics controller module 818, or any suitable component of the inkjet printing system 814. Similarly, in other embodiments, the measurement device 800 may be an integral component of the print head assembly 812, electronics controller module 818, or any suitable component of the inkjet printing system 814.

Figure 9:
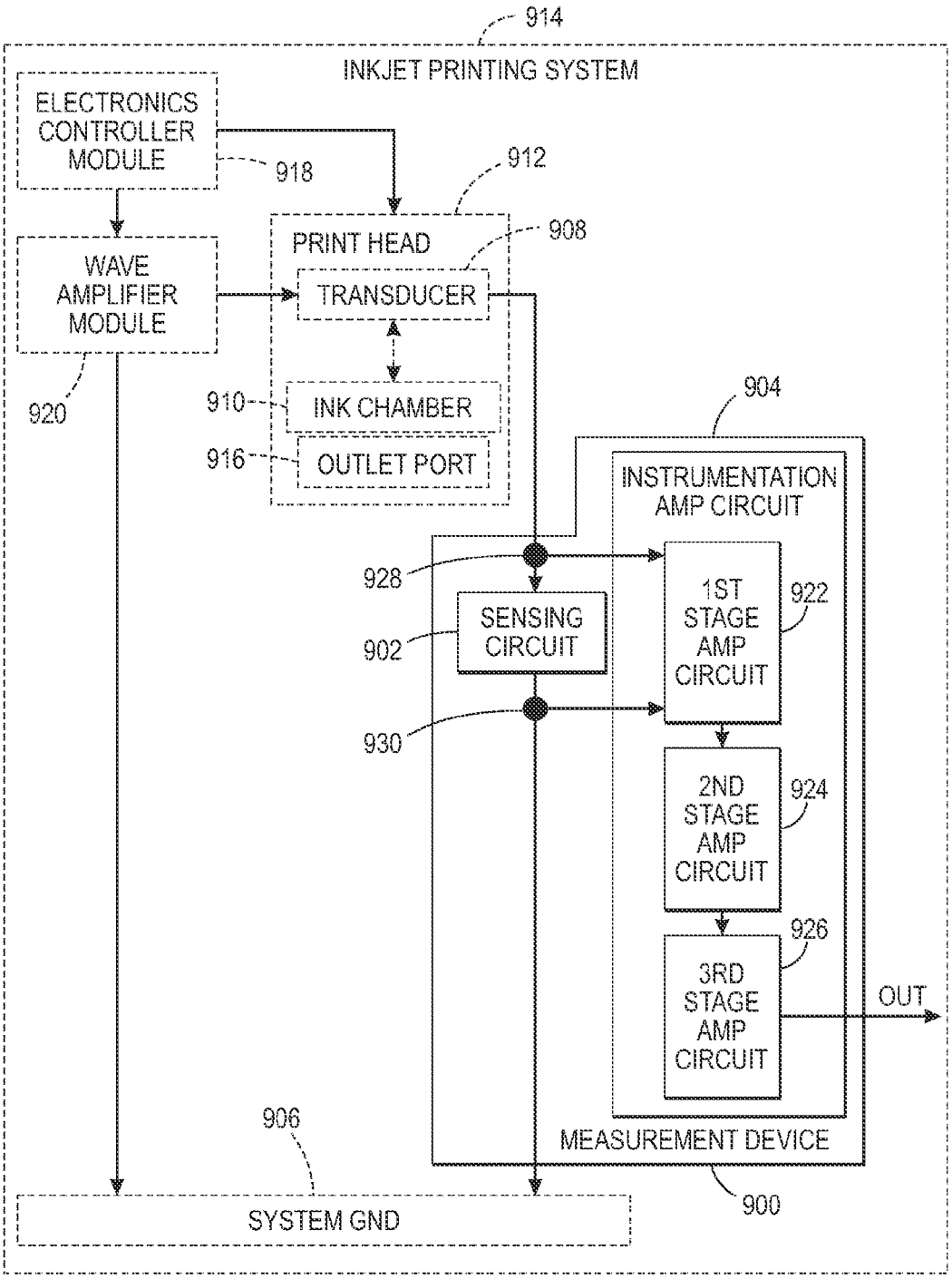
FIG. 9 is a block diagram of another exemplary embodiment of a measurement device for measuring a response to actuation of an electro-mechanical transducer in a print head assembly for an inkjet printing system.

With reference to FIG. 9, a measurement device 900 for measuring a response to actuation of an electro-mechanical transducer in a print head assembly for an inkjet printing system includes a sensing circuit 902 and an multi-stage amplifier circuit 904. The sensing circuit 902 is configured to provide at least a portion of a return path to system ground 906 for an electro-mechanical transducer 908. The electro-mechanical transducer 908 is associated with an ink chamber 910 in a print head assembly 912 for an inkjet printing system 914. The electro-mechanical transducer 908 is configured to transfer energy to contents of the ink chamber 910 in response to an actuation of the electro-mechanical transducer 908 in conjunction with electronics controller and waveform amplifier modules 918, 920 of the inkjet printing system 914. The drive signal for actuation of the electro-mechanical transducer 908 may be for ejection of ink through an outlet port 916 of the ink chamber 910. Alternatively, the drive signal may a sub-ejection signal for other purposes, such as for warming the ink.

The multi-stage amplifier circuit 904 is in operative communication with the sensing circuit 902 and includes first, second, and third stage amplifier circuits 922, 924, 926. The first stage amplifier circuit 922 is configured to monitor a ground signal at an electro-mechanical transducer-side 928 of the sensing circuit 902 and a reference signal at a system ground-side 930 of the sensing circuit 908. The first stage amplifier circuit 922 is also configured to generate a difference signal indicative of a difference between the ground and reference signals. The first amplifier circuit 922 may include an instrumentation amplifier. The second and third stage amplifier circuits 924, 926 are in operative communication with the first stage amplifier circuit 922 and configured to condition and amplify the difference signal to generate a response signal indicative of a response of the electro-mechanical transducer 908 to fluidic pressure waves within the ink chamber 910 after actuation of the electro-mechanical transducer 908. As shown, the first, second, and third stage amplifier circuits 922, 924, 926 may be arranged in series.

In another embodiment, the electro-mechanical transducer 908 includes a piezoelectric transducer. In yet another embodiment of the measurement circuit 900, the sensing circuit 902 includes a current shunt device. In still another embodiment of the measurement circuit 900, the sensing circuit 902 includes a sensing resistor. In still yet another embodiment of the measurement circuit 900, the second and third stage amplifier circuits 924, 926 are also configured to use at least one of high-pass filtering, band-pass filtering, low-pass filtering, or any suitable form of signal conditioning in any suitable combination in conjunction with the conditioning. For example, high-pass and low-pass filtering can be arranged to produce band-pass filtering. In another embodiment of the measurement circuit 900, the second and third stage amplifier circuits 924, 926 each include overvoltage protection diodes configured to limit overdriving the corresponding amplifier circuit. In this embodiment, the diodes improve performance of the amplifier circuits by preventing the corresponding amplifier from going into saturation.

In yet another embodiment of the measurement circuit 900, the multi-stage amplifier circuit 904 also includes a high-pass filter between the first and second stage amplifier circuits 922, 924 in conjunction with conditioning the difference signal. In this embodiment, the multi-stage amplifier circuit 904 also includes a low-pass filter between the second and third stage amplifier circuits 924, 926 in conjunction with conditioning an intermediate signal associated with the response signal. In a further embodiment, the low-pass filter includes a two-stage low-pass filter.

In still another embodiment of the measurement circuit 900, the multi-stage amplifier circuit 904 is configured to facilitate recording of the response signal over a select time period for subsequent testing of at least one of the print head assembly 912, inkjet printing system 914, or any combination of components of the inkjet printing system 914. In still yet another embodiment, the measurement circuit 900 also includes a storage device in operative communication with the multi-stage amplifier circuit 904 and configured to at least temporarily store a recording of the response signal over a select time period for subsequent testing of at least one of the print head assembly 912, inkjet printing system 914, or any combination of components of the inkjet printing system 914.

In other embodiments, the storage device may be an integral component of the measurement circuit 900, print head assembly 912, electronics controller module 918, or any suitable component of the inkjet printing system 914. Similarly, in other embodiments, the measurement device 900 may be an integral component of the print head assembly 912, electronics controller module 918, or any suitable component of the inkjet printing system 914.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for measuring a response to actuation of an electro-mechanical transducer in a print head assembly for an inkjet printing system, comprising:

providing at least a portion of a return path to system ground for an electro-mechanical transducer through a sensing circuit, wherein the electro-mechanical transducer is associated with an ink chamber in a print head assembly for an inkjet printing system, wherein the electro-mechanical transducer is configured to transfer energy to contents of the ink chamber in response to an actuation of the electro-mechanical transducer in conjunction with electronics controller and waveform amplifier modules of the inkjet printing system;

monitoring a ground signal from an electro-mechanical transducer-side of the sensing circuit at a first stage amplifier circuit of a measurement circuit;

monitoring a reference signal from a system ground-side of the sensing circuit at the first stage amplifier circuit;

generating a difference signal indicative of a difference between the ground and reference signals at the first stage amplifier circuit; and conditioning and amplifying the difference signal at second and third stage amplifier circuits of the measurement circuit to generate a response signal indicative of a response of the electro-mechanical transducer to fluidic pressure waves within the ink chamber after actuation of the electro-mechanical transducer, the conditioning and amplifying comprising:

filtering the difference signal at a high-pass filter between the first and second stage amplifier circuits in conjunction with conditioning the difference signal to form a first intermediate signal; and filtering the first intermediate signal at a low-pass filter between the second and third stage amplifier circuits in conjunction with conditioning the first intermediate signal to form a second intermediate signal;

wherein the third stage amplifier circuit conditions and amplifies the second intermediate signal to form the response signal.

2. The method of claim 1 wherein the conditioning includes at least one of high-pass filtering, band-pass filtering, and low-pass filtering.

3. The method of claim 1, further comprising:

recording the response signal over a select time period for subsequent testing of at least one of the print head assembly or inkjet printing system.

4. The method of claim 1, further comprising:

at least temporarily storing a recording of the response signal over a select time period in a storage device for the subsequent testing of at least one of the print head assembly or inkjet printing system.

5. An apparatus for measuring a response to actuation of an electro-mechanical transducer in a print head assembly for an inkjet printing system, comprising:

a sensing circuit configured to provide at least a portion of a return path to system ground for an electro-mechanical transducer, wherein the electro-mechanical transducer is associated with an ink chamber in a print head assembly for an inkjet printing system, wherein the electro-mechanical transducer is configured to transfer energy to contents of the ink chamber in response to an actuation of the electro-mechanical transducer in conjunction with electronics controller and waveform amplifier modules of the inkjet printing system; and a measurement circuit in operative communication with the sensing circuit and configured to monitor a ground signal at an electro-mechanical transducer-side of the sensing circuit and a reference signal at a system ground-side of the sensing circuit, wherein the measurement circuit is also configured to generate a difference signal indicative of a difference between the ground and reference signals;

wherein the measurement circuit is also configured to condition and amplify the difference signal to generate a response signal indicative of a response of the electro-mechanical transducer to fluidic pressure waves within the ink chamber after actuation of the electro-mechanical transducer, the measurement circuit comprising:

a multi-stage amplifier circuit with first, second, and third amplifier stages, wherein the first amplifier stage is configured to generate the difference signal and second and third amplifier stages are configured to generate the response signal, the multi-stage amplifier circuit comprising:

a high-pass filter between the first and second stage amplifier circuits in conjunction with conditioning the difference signal; and a low-pass filter between the second and third stage amplifier circuits in conjunction with conditioning an intermediate signal associated with the response signal.

6. The apparatus of claim 5 wherein the electro-mechanical transducer includes a piezoelectric transducer.

7. The apparatus of claim 5 wherein the sensing circuit includes a current shunt device.

8. The apparatus of claim 5 wherein the sensing circuit includes a sensing resistor.

9. The apparatus of claim 5 wherein the measurement circuit is configured to use at least one of a differential amplifier circuit, an operational amplifier circuit, and a multi-stage amplifier circuit in conjunction with generating the difference signal.

10. The apparatus of claim 5, further comprising:

a storage device in operative communication with the measurement circuit and configured to at least temporarily store a recording of the response signal over a select time period for subsequent testing of at least one of the print head assembly or inkjet printing system.

11. An apparatus for measuring a response to actuation of an electro-mechanical transducer in a print head assembly for an inkjet printing system, comprising:

a sensing circuit configured to provide at least a portion of a return path to system ground for an electro-mechanical transducer, wherein the electro-mechanical transducer is associated with an ink chamber in a print head assembly for an inkjet printing system, wherein the electro-mechanical transducer is configured to transfer energy to contents of the ink chamber in response to an actuation of the electro-mechanical transducer in conjunction with electronics controller and waveform amplifier modules of the inkjet printing system;

a multi-stage amplifier circuit in operative communication with the sensing circuit, the multi-stage amplifier circuit comprising:

a first stage amplifier circuit configured to monitor a ground signal at an electro-mechanical transducer-side of the sensing circuit and a reference signal at a system ground-side of the sensing circuit, wherein the first stage amplifier circuit is also configured to generate a difference signal indicative of a difference between the ground and reference signals;

second and third state amplifier circuits in operative communication with the first stage amplifier circuit and configured to condition and amplify the difference signal to generate a response signal indicative of a response of the electro-mechanical transducer to fluidic pressure waves within the ink chamber after actuation of the electro-mechanical transducer;

a high-pass filter between the first and second stage amplifier circuits in conjunction with conditioning the difference signal; and a low-pass filter between the second and third stage amplifier circuits in conjunction with conditioning an intermediate signal associated with the response signal.

12. The apparatus of claim 11 wherein the second and third stage amplifier circuits are also configured to use at least one of high-pass filtering, band-pass filtering, and low-pass filtering in conjunction with the conditioning.

13. The apparatus of claim 11, the second and third stage amplifier circuits each comprising:

overvoltage protection diodes configured to limit overdriving the corresponding amplifier circuit.

14. The apparatus of claim 11, the low-pass filter comprising:

a two-stage low-pass filter.

15. The apparatus of claim 11, further comprising:

a storage device in operative communication with the multi-stage amplifier circuit and configured to at least temporarily store a recording of the response signal over a select time period for subsequent testing of at least one of the print head assembly or inkjet printing system.

* * * * *